United States Patent [19]

Rivera

[11] Patent Number: 4,908,883

[45] Date of Patent: Mar. 20, 1990

[54] VANDAL RESISTANT PUSH-PULL DRAIN STOPPER

[75] Inventor: Samuel T. Rivera, Saugus, Calif.

[73] Assignee: Price Pfister, Inc., Pacoima, Calif.

[21] Appl. No.: 195,512

[22] Filed: May 18, 1988

[51] Int. Cl.[4] ..... A47K 1/14

[52] U.S. Cl. ..... 4/295; 4/287; 4/204; 4/286

[58] Field of Search ..... 4/286–288, 4/293, 295, 204–206; 137/454.5, 316, 327; 251/297

[56] References Cited

U.S. PATENT DOCUMENTS

| | | | |
|---|---|---|---|
| 4,369,531 | 1/1983 | Swanson | 4/295 |
| 4,420,844 | 12/1983 | Puckett et al. | 4/295 |
| 4,720,877 | 1/1988 | Watts | 4/286 |

*Primary Examiner*—Henry J. Recla
*Assistant Examiner*—Robert Fetsuga
*Attorney, Agent, or Firm*—Barry E. Deutsch

[57] ABSTRACT

In a vandal resistant push-pull drain stopper for use with a drain plug of a bathtub or other similar vessel, there is provided a plunger having an inner cylindrical bore, a stem having a reduced portion, an expanded portion and a channeled portion, an O-ring snugly nestled between the stopper and the stem; a cap threadably engaged with the stopper and axially disposed about the upper region of the stem, the cap having a relief inside the hexagonal bore portion thereof so that the stopper freely rotates about the cap by discouraging removal of the cap from the drain stopper; the plunger having a seal radially disposed about the plunger so that when the stopper is in a closed position the seal abuts with the outer periphery of the drain plug thereby sealing the same. The reduced, expanded and channeled portion of the stem permit the drain plug to be open and closed by user and provide tactile "snap in place feel" in the open and close positions while employing only, essentially, two moving parts.

15 Claims, 1 Drawing Sheet

VANDAL RESISTANT PUSH-PULL DRAIN STOPPER

FIELD OF THE INVENTION

The present invention relates to drain stoppers, and more particularly to a push-pull vandal resistant drain stopper for bathtubs or other similar vessels.

BACKGROUND OF THE INVENTION

Over the years, different types of drain stoppers have been developed in the prior art. For example, drain stoppers having a complicated lever action, wherein the lever which opens and closes the drain stopper is located in close proximity to the spout of the bathtub, are well known in the prior art. However, such drain stoppers have serious drawbacks in that the stopper is removable from the linkage mechanism of the lever, thereby encouraging vandalism in hotel bathrooms and other settings having public access, and also, the linkage mechanism from the lever to the stopper often breaks and is complicated and expensive to manufacture.

In order to overcome the drawbacks associated with such lever drain stoppers, various prior art drain stoppers have been developed which do not require a lever and which may be open and closed by applying pressure to the stopper so that in response to either rubber or spring biasing, the drain stopper pops up to open or compresses to close. The disadvantage of such prior art drain stoppers is that the springs often wear with use and create an ineffective seal. Furthermore, such prior art drain stoppers require complicated cam-shaped parts having interlocking mechanisms which may eventually wear and malfunction and are expensive to machine and manufacture. Other prior art stoppers are of the lift and turn type which are confusing because the direction of turning is not obvious. Also they require components that are costly to manufacture.

Most non-lever operated stoppers that are wholly contained within the drain of a tub are prone to theft since they may be readily removed from the drain. Various attempts have been made to deter theft and vandalism of drain stoppers. U.S. Pat. No. 4,369,531 issued to Swanson discloses a drain stopper having a spring biased plunger. This stopper assembly is secured to the drain body (sometimes referred to in the plumbing fixture industry as a drain plug or spud) such that it cannot be removed from the body without removing the body from the tub. While the stopper disclosed by Swanson is thus inherently vandal resistant, it is difficult to service or replace.

A tamper resistant push-pull type of stopper is disclosed in U.S. Pat. No. 4,720,877 issued to Watts. In order to remove this stopper from a drain on which it is installed, a knob portion of the stopper must first be removed to provide access to a central post which secures the stopper assembly to the drain plug.

SUMMARY OF THE INVENTION

The obstacles and drawbacks contained in the prior art are overcome in a vandal resistant push-pull drain stopper, the drain stopper comprising: a plunger, the plunger having an inner cylindrical bore and a bottom seat portion; a stem, the stem having a reduced portion, an expanded portion and a channel portion.

The invented drain stopper also includes a resilient member, such as an O-ring, serving as a friction means, the friction means being disposed between the stem and the plunger at the bottom seat portion of the plunger; the stem being disposed axially along the chamber of the plunger, the stem having a lower portion for removably coupling and decoupling the stem to a drain plug.

The invented drain stopper also includes a cap removably fixedly engaged with the plunger and axially disposed about the upper region of the stem, the cap having a hexagonal bore portion and a relief area inside thereof.

The invented drain stopper also includes a sealing means circumferentially disposed at a substantially horizontal angle about the outer periphery of the plunger and in substantial crosssectional alignment with the upper periphery of the drain plug; the plunger having an inner threaded bore area for threadably receiving the threaded bore portion of the cap and so that the relief area inside the hexagonal bore area of the cap permits the cap and plunger to rotate freely about the stem without becoming threadably disengaged therefrom, thereby discouraging threadable disengagement of the cap from the stopper.

As such, when the drain stopper is in the closed position and the seal is in abutting and sealing relationship with the outer periphery of the drain plug, the resilient means is in snug abutting relationship with the reduced portion of the stem such that when a user pulls the cap in a first direction, the plunger moves therewith and pulls the resilient means in the first direction such that the resilient means encounters the expanded portion of the stem thereby providing a resistance against the pulling in the first direction of the cap until the resilient means is pulled in the first direction along the expanded portion, onto the channel portion of the stem wherein the resilient means contracts within the channel portion such that the drain stopper snaps into open position.

DETAILED DESCRIPTION OF THE INVENTION

Figure 1:
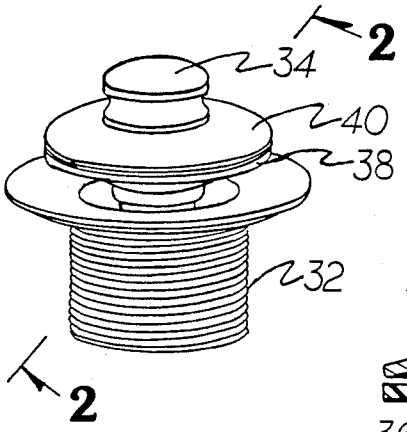
FIG. 1 shows a perspective view of the invented drain stopper.
Figure 2:
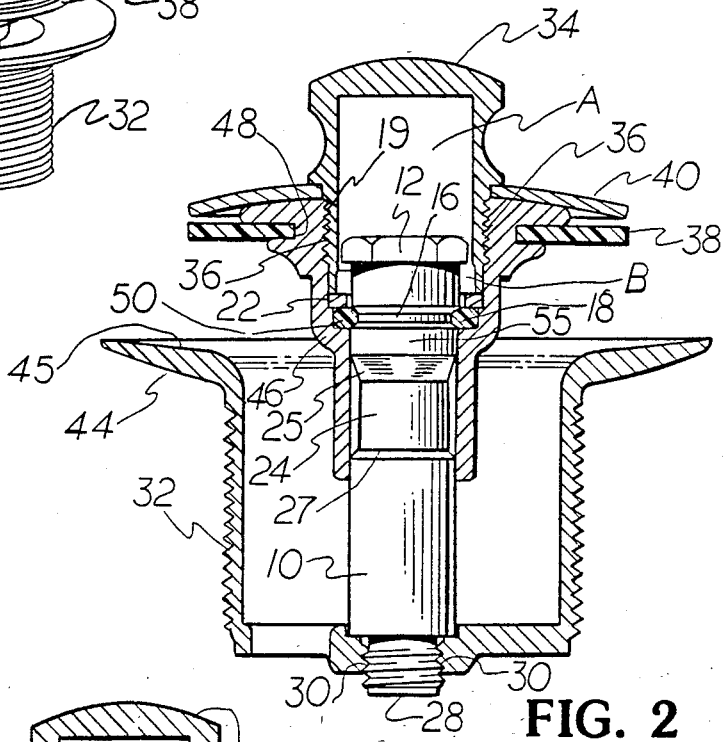
FIG. 2 shows a partial cross-sectional view of the invented drain stopper in the open position.

The invented vandal proof drain stopper is installed on a drain plug 44 having a threadable outer surface 32, which is threadably engaged with a water outlet source of a bathtub or other similar vessel. The drain stopper operates within the plug 44 to close or open the drain plug. The drain stopper has a lower threaded stud portion 28 which threadably engages with a bore 30 in the lower region of the drain plug 44. Rising upwardly from the threaded stud portion 28 is a stem 10, which has various configurations which will later be described. In snug contact and circumferentially surrounding the stem 10 is a plunger 46. The stem 10 is fixedly maintained within the drain plug by virtue of the stem's threadable engagement of stud portion 28 with threaded bore 30 of the drain plug. In the preferred embodiment, the plunger 46 and stem 10 are comprised, respectively of thermoplastic material and brass, however, it will be appreciated that other similar materials may be used.

The stem 10 has a polygonal (preferably hexagonal) head 12 which facilitates a tight and secure engagement with threaded bore 30 of the drain plug 44. The knob 34 has a relief A inside the polygonal (preferably hexagonal) bore B so that the knob 34 and plunger 46 assembly rotate freely about the stem so that mere turning of the knob 34 will not unthread the cap 40 from the drain stopper assembly as long as hexagonal head 12 is within relief area A. As such, the stem 10 will not become easily threadably disengaged from the drain plug 44, thereby greatly discouraging removal of the knob and plunger assembly, thereby preventing vandalism of the drain plug and knob.

The plunger 46 goes upwardly and downwardly in a vertical direction guided by the stem 10 in response to manual upward pulling or pushing on knob 34. The know 34 has a threaded portion 19 which is threadably engaged with a threaded portion 36 of the plunger 46, so that the knob and the plunger work together as an integral unit. Fixedly mounted between the knob 34 and the plunger 46 is a cap 40, which serves as a decorative cover protection of seal 38 which is mounted within circumferential groove 48 of the plunger 46.

Figure 3:
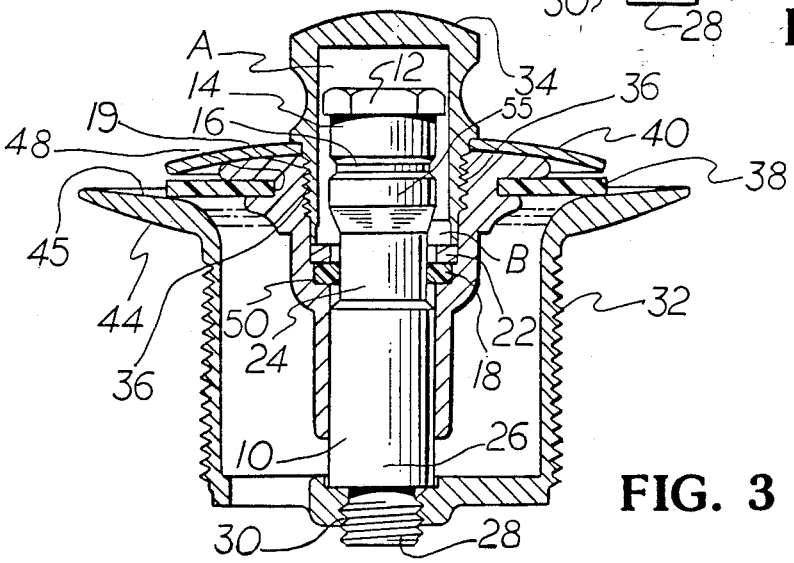
FIG. 3 shows a partial cross-sectional view of the invented drain stopper in the closed position.

Upward pulling on the knob 34 brings the seal 38 to its open position, thereby opening the drain while downward pushing on the knob 34 engages the seal 38 into sealing contact with an outer circumferential flange 45 of the drain plug 44, as shown in Figure 3, thereby effectively sealing the drain.

The stem 10 has a reduced portion 24, a tapered portion 25, an expanded portion 55 and a channeled portion 16. The significance of this structure will later be described.

An O-ring 18 is disposed within the inner diameter of the plunger 46 and is retained against seat 50 by metal washer 22. Washer 22 is in turn retained by knob 34. The O-ring 18 acts as a frictional element. In the plunger's closed position, the inner circumference of this O-ring rests within the reduced area 24 of the plunger 46, the O-ring being maintained in a snugly seated position between the metal washer 22 and a bottom seat portion 50 of the stem 10, as shown in FIG. 3.

When plunger 46 and the seal 38 are in their closed position and a user grips the knob 34 and pulls upwardly thereupon, the plunger 46 moves in concert and brings with it the O-ring 18, which then moves upwardly along reduced portion 24 to tapered portion 25, thereby giving the user a tactile feedback that the plunger is encountering a force opposing the pulling force of the user. As the knob 34 is upwardly pulled the plunger pulls the O-ring (which is resilient) onto an expanded portion 55 of the stem 10, thereby providing a greater resisting force to the user. As the user continues to pull upwardly, the O-ring contracts from its expanded position at expanded portion 55, which position gives greater opposing force to the pulling force exerted by the user, to a contracted position wherein the O-ring contracts into nesting engagement within the channel 16 of the stem 10. This is accomplished with a tactile "snap in place" feel, such that the user has further tactile feedback that the knob is in its fully open position.

In order to remove the drain stopper assembly, the knob must be deliberately pulled beyond its fully open position and turned at the same time so that the hexagonal bore B of the knob 34 will engage with the hexagonal head 12 of the stem 10, and also overcome the resistance of O-ring 18 against stem 10. This motion is not natural but must be done with the knowledge of how the vandal resistant mechanism works.

Conversely, when pushing the knob downwardly, a user first encounters greater resistance when the O-ring is forced to expand over expanded portion 55, somewhat less friction as the O-ring is forced over tapered portion 25 and little resistance when the O-ring enters the region of reduced area 24, wherein the O-ring is in a relaxed condition in its closed position, as shown in FIG. 3.

From the forgoing description it will be appreciated that the invented push-pull drain stopper is vandal resistant and offers an effective drain stopper which gives highly satisfactory tactile feedback to the user and employs, essentially, only two moving parts (stopper 46 and O-ring 18) thereby presenting an effective drain stopper which is easy to manufacture at a relatively low cost. Further, since the invented drain stopper employs only a few parts and does not rely upon springs or complicated cam-actions, such as other prior art stoppers, the invented drain stopper can be used virtually for years without the need for mechanical maintenance or replacement.

The foregoing description is for illustrative purposes only. It will be appreciated therefore that the exact dimensions and details of the invented drain stopper may be varied without departing from the essential spirit and scope of the subject invention and that all variations within the meaning and range of equivalency of the following claims are intended to be embraced herein.

What is claimed is:

1. A vandal resistant push-pull drain stopper for use with a drain plug adapted to be mounted in an outlet opening of a bathtub or other similar vessel, said drain stopper comprising:

a plunger having a generally cylindrical bore;

a stem having a polygonal head at one end thereof, said stem at the opposite end thereof adapted to be; threadably coupled to said drain plug and coaxially disposed therein, said one end of said stem being slidably disposed within said generally cylindrical bore of said plunger;

said plunger being selectively moveable axially between a closed position, an open position, and a removal position;

movement regulating means for regulating said axial movement of said plunger;

a knob threadably coupled to said plunger having a polygonal bore for engaging said polygonal head of said stem when said plunger is in said removal position and a relief area within which said polygonal head can freely rotate when said plunger is in said open and closed positions; and sealing means disposed peripherally about said plunger adapted to seal against said drain plug when said plunger is in said closed position;

whereby rotation of said knob when said plunger is in said removal position causes said stem to rotate with respect to said drain plug and rotation of said knob when said plunger is in said open and closed positions causes said plunger to rotate freely about said stem.

2. The apparatus according to claim 1 wherein said movement regulating means comprises resilient friction means disposed within said generally cylindrical bore of said plunger and bearing against said stem.

3. The apparatus of claim 2 wherein said resilient friction means comprises an O-ring and wherein said stem further comprises an annular reduced portion and an annular channeled portion between said opposite ends, said O-ring surrounding said reduced portion when said plunger is in said closed position and surrounding said channeled portion when said plunger is in said open position.

4. The apparatus of claim 3 wherein said plunger further comprises a seat portion within said generally cylindrical bore and said apparatus further comprises retaining means for retaining said O-ring against said seat portion.

5. The apparatus according to claim 4 wherein said stem further comprises an expanded portion between said reduced and channeled portions such that when said plunger is moved axially from said closed position toward said open position said O-ring is compressed, thereby offering resistance to said axial motion of said plunger, and such that said O-ring snaps into said channeled portion when said plunger reaches said open position.

6. The apparatus according to claim 5 wherein said plunger is comprised of unitary thermoplastic material.

7. The apparatus according to claim 5 wherein said stem is substantially comprised of unitary metallic material.

8. A vandal resistant push-pull drain stopper for use with a drain plug adapted to be mounted in an outlet opening of a bathtub or other similar vessel, said drain stopper comprising:

a plunger having a generally cylindrical bore and a seat portion therein;

a stem having a polygonal head at one end thereof, said stem at the opposite end thereof adapted to be threadably coupled to said drain plug and coaxially disposed therein, said one end of said stem being slidably disposed within said generally cylindrical bore of said plunger, said item further including an annular reduced portion and an annular channeled portion between said opposite ends;

an O-ring disposed around said stem;

retaining means for retaining said O-ring against said seat portion;

said plunger being selectively moveable axially between a closed position wherein said O-ring surrounds said reduced portion of said stem, an open position wherein said O-ring surrounds said channeled portion of said stem and a removal position;

a knob threadably coupled to said plunger having a polygonal bore for engaging said polygonal head of said stem when said plunger is in said removal position and a relief area within which said polygonal head can freely rotate when said plunger is in said open and closed positions; and sealing means disposed peripherally about said plunger adapted to seal against said drain plug when said plunger is in said closed position;

whereby rotation of said knob when said plunger is in said removal position causes said stem to rotate with respect to said drain plug and rotation of said knob when said plunger is in said open and closed positions causes said plunger to rotate freely about said stem.

9. The apparatus according to claim 8 wherein said stem further comprises an expanded portion between said reduced and channeled portions such that when said plunger is moved axially from said closed position toward said open position said O-ring is compressed, thereby offering resistance to said axial motion of said plunger, and such that said O-ring snaps into said channeled portion when said plunger reaches said open position.

10. The apparatus according to claim 9 wherein said plunger is comprised of unitary thermoplastic material.

11. The apparatus according to claim 9 wherein said stem is substantially comprised of unitary metallic material.

12. A vandal resistant push-pull drain assembly for use with a bathtub or other similar vessel having a drain, said drain assembly comprising:

a drain plug adapted to be mounted in an outlet opening of a bathtub or other similar vessel;

a plunger having a generally cylindrical bore and a seat portion therein;

a stem having a polygonal head at one end thereof, said stem at the other end thereof being threadably coupled to said drain plug and coaxially disposed therein, said one end of said stem being slidably disposed within said generally cylindrical bore of said plunger, said stem further including an annular reduced portion and an annular channeled portion between said opposite end;

an O-ring disposed around said stem;

retaining means for retaining said O-ring against said seat portion;

said plunger being selectively moveable axially between a closed position wherein said O-ring surrounds said reduced portion of said stem, an open position wherein said O-ring surrounds said channeled portion of said stem and a removal position;

a knob threadably coupled to said plunger having a polygonal bore for engaging said polygonal head of said stem when said plunger is in said removal position and a relief area within which said polygonal head can freely rotate when said plunger is in said open and closed positions; and sealing means disposed peripherally about said plunger for sealing against said drain plug when said plunger is in said closed position;

whereby rotation of said knob when said plunger is in said removal position causes said stem to rotate with respect to said drain plug and rotation of said knob when said plunger is in said open and closed positions causes said plunger to rotate freely about said stem.

13. The apparatus according to claim 12 wherein said stem further comprises an expanded portion between said reduced and channeled portions such that when said plunger is moved axially from said closed position toward said open position said O-ring is compressed, thereby offering resistance to said axial motion of said plunger, and such that said O-rings snaps into said channeled portion when said plunger reaches said open position.

14. The apparatus according to claim 13 wherein said plunger means is comprised of unitary thermoplastic material.

15. The apparatus according to claim 13 wherein said stem is substantially comprised of unitary metallic material.

* * * * *